US005191834A

United States Patent [19]

Fuhrmann et al.

[11] Patent Number: 5,191,834

[45] Date of Patent: Mar. 9, 1993

[54] PRINTING SYSTEM WITH PRINTING FORM HAVING A FERRO-ELECTRIC LAYER

[75] Inventors: Hartmut Fuhrmann, Karlsfeld; Alfred Hirt, Munich, both of Fed. Rep. of Germany

[73] Assignee: Man Roland Druckmaschinen AG, Offenbach am Main, Fed. Rep. of Germany

[21] Appl. No.: 609,009

[22] Filed: Oct. 29, 1990

Related U.S. Application Data

[63] Continuation of Ser. No. 418,137, Oct. 6, 1989, abandoned.

[30] Foreign Application Priority Data

Oct. 14, 1988 [DE] Fed. Rep. of Germany ..... 335091

[51] Int. Cl.[5] ..... B41N 1/10

[52] U.S. Cl. ..... 101/130; 101/467; 101/478

[58] Field of Search ..... 400/119; 101/DIG. 37, 101/130, 467, 478; 346/74.2, 74.5

[56] References Cited

U.S. PATENT DOCUMENTS

| | | | |
|---|---|---|---|
| 3,477,368 | 11/1969 | Spaulding | 400/119 |
| 3,561,358 | 2/1971 | Wiegl | 101/170 |
| 3,647,291 | 3/1972 | Pressman et al. | 355/3 |
| 3,684,075 | 8/1972 | Stauer et al. | 400/119 |
| 3,963,340 | 6/1976 | Gerace | 101/111 |
| 3,999,481 | 12/1976 | Sankus, Jr. | 101/170 |
| 4,187,774 | 2/1980 | Iwasa et al. | 101/494 |
| 4,227,452 | 9/1980 | Tamai | 101/DIG. 37 |
| 4,307,165 | 12/1981 | Blazey et al. | 101/151 |
| 4,321,606 | 3/1982 | Lazzari | 400/119 |
| 4,444,858 | 4/1984 | Nishibu et al. | 101/465 |
| 4,463,676 | 8/1984 | Harada et al. | 400/119 |
| 4,602,879 | 7/1986 | Takagi | 400/119 |
| 4,729,310 | 3/1988 | Love, III | 101/466 |
| 4,833,990 | 5/1989 | Hirt et al. | 101/130 |
| 4,877,341 | 9/1989 | Cherbuy et al. | 400/119 |

FOREIGN PATENT DOCUMENTS

| | | |
|---|---|---|
| 1957403 | 6/1970 | Fed. Rep. of Germany . |
| 2809790 | 9/1978 | Fed. Rep. of Germany . |
| 3016245 | 10/1980 | Fed. Rep. of Germany . |
| 3633758 | 4/1988 | Fed. Rep. of Germany . |

*Primary Examiner*—Edgar S. Burr
*Assistant Examiner*—John S. Hilten
*Attorney, Agent, or Firm*—Frishauf, Holtz, Goodman & Woodward

[57] ABSTRACT

To provide an electrically controllable printing form, on which the printing image is retained even upon repeated application of printing toner or printing ink formed of toner suspended in a carrier liquid, the printing form (10) has a surface layer (12) of ferroelectric material or, if a gravure form (40), the cells (31) have a bottom (32) of ferroelectric material. The form is programmed under control of a control unit (13, 13') by an electrode (14, 14') which selectively polarizes the ferroelectric material. Upon application of electrically charged toner or ink, the ink or toner particles which are charged oppositely to the polarization of the ferroelectric layer or bottom will be retained, the equally charged particles repelled, so that, by selective positive or negative polarization, two-color printing can be effected at one pass of a printing substrate over the form.

16 Claims, 2 Drawing Sheets

PRINTING SYSTEM WITH PRINTING FORM HAVING A FERRO-ELECTRIC LAYER

This application is a continuation of application Ser. No. 07/418,137, filed Oct. 6, 1989, now abandoned.

FIELD OF THE INVENTION

Reference to related patent and application, the disclosures of which are hereby incorporated by reference: U.S. Pat. No. 4,833,990, Hirt and Fuhrmann U.S. Ser. No. 07/422,782, filed Oct. 17, 1989, Engl et al U.S. Pat. No. 3,647,291, Pressman et al, to which German Patent 1,957,403 corresponds.

The present invention relates to a printing form, and more particularly to a printing form suitable for repetitive printing of the same subject matter, that is, useful in a printing machine, as well as for other reproduction machinery, such as copy machines and the like, in which electrically charged ink or toner elements are selectively and controllably transferred to the printing form by means of an electrostatic field for subsequent transfer to a carrier substrate such as, for example, a web of paper, textile material, plastic foils or the like.

BACKGROUND

U.S. Pat. No. 3,647,291, Pressman et al describes a printing form which essentially includes a dielectric having electrodes associated therewith. An ion source and an optical system, controlled by the image, generates a corresponding charge image on the surface of the printing form. Charged toner particles are then accepted on the charged image surface in accordance with the original image. Toner is then transferred from the printing form to the substrate by contact. The charge on the printing form is neutralized upon acceptance of the toner, and thus the printing form must be again programmed with the image before it can carry out a new printing operation. The charge image, thus, must be refreshed or newly generated after each transfer of toner.

U.S. Pat. No. 4,833,990, Hirt and Fuhrmann, claiming priority of German 36 44 758, describes the use of ferroelectric materials in printing machines. The disclosure is specifically directed to offset printing machines using inks conventional in offset printing, that is, oil-based inks in combination with damping liquids, typically water. The system uses the characteristics of ferroelectric material that differentially polarized localities of the ferroelectric material have differential affinity for oil and water. Polarized parts are hydrophilic and accept water, whereas depolarized materials are hydrophobic, so that they can accept printing ink.

THE INVENTION

It is an object to provide a printing form which does not require re-generation of an image each time the ink has been transferred.

Briefly, an ink transferring layer, supported on a support structure, is formed of ferroelectric material; this permits formation of an image pattern on the printing form which, once generated, will remain so that ink or toner can be continuously applied to the printing form, for application to a printing substrate without intermediate refreshing or re-generation of the printed image. Once the printing form has been programmed, it will accept electrically charged toner or ink upon passage past an inker, for transfer of the ink to the substrate, without destruction or discharge of the polarization image. This is in contrast to the prior art system of the referenced Pat. No. 4,833,990, in which on electric field to electrically charge ink elements is not used. In contrast, and in accordance with the present invention electrically charged toner or ink particles are applied on the ferroelectric material which has, previously, been polarized.

In accordance with a feature of the invention, it has been found, surprisingly, that the system permits multicolor printing with a single passage of the substrate past the printing form. The ferroelectric material can be differentially polarized, positively, negatively, or remain neutral within very small areas. Then, two inks or toners of differentially charged ink or toner particles can be applied to the respective differentially polarized domains of the ferroelectric material. One ink, for example, can be charged positively, to be attracted by a negative domain, but repelled by a positive domain; another ink of a different color can be charged positively, for attraction by a negative domain and repulsion by a positive domain; and neutral regions of the ferroelectric material will not have any particles adhere thereto. Thus, for multi-color printing, a lesser number of runs through a printing cylinder by the substrate is needed.

The printing form can be used with dry toners, as well as with liquid toners in which a liquid substance acts as a carrier for the toner.

In accordance with a feature of the invention, the printing form can be either a planar form or a gravure form. Thus, the carrier for the ferroelectric material may be a highly wear-resistant material such as a metal or ceramic formed with cells or receptor depressions as well known in gravure printing technology. The bottoms of the cells or depressions include the ferroelectric material.

The printing form in accordance with the present invention preferably is used with a control system in which the ferroelectric bottoms of the cells are polarized with differential intensity in accordance with the grey tone of the associated image point. Formation of grey tones can be as desired, for example by varying the number of the polarized cells, so that only a binary polarization is needed; other gravure printing forms, conventional or inverted half-tone systems can be used.

In accordance with a preferred feature of the invention, those cells which should accept ink are polarized oppositely to the cells which should not have any ink therein. After programming of the gravure form, the cells are filled with a carrier liquid, including toner, or with charged toner particles directly. A doctor blade or stripping roller contacting the surface of the printing form acts on the electrical field effective against the polarized bottom of the cells similarly to a counter electrode. Thus, the space between the bottom of the cells and the doctor blade or stripping roller will have a strong electrical field therein which, in dependence on the polarization, deposits toner material at the bottom of the cell or on the doctor blade or stripping roller, respectively. By doctoring, thus, the ink or toner quantity within the cells can be controlled. The ink remaining in the cells is transferred to a printing substrate in accordance with conventional gravure printing technology.

Control of ink by doctoring or by a stripping roller is improved by charging the doctor blade or the stripping roller to an appropriately high electrical voltage.

DRAWINGS

DETAILED DESCRIPTION

Figure 1:
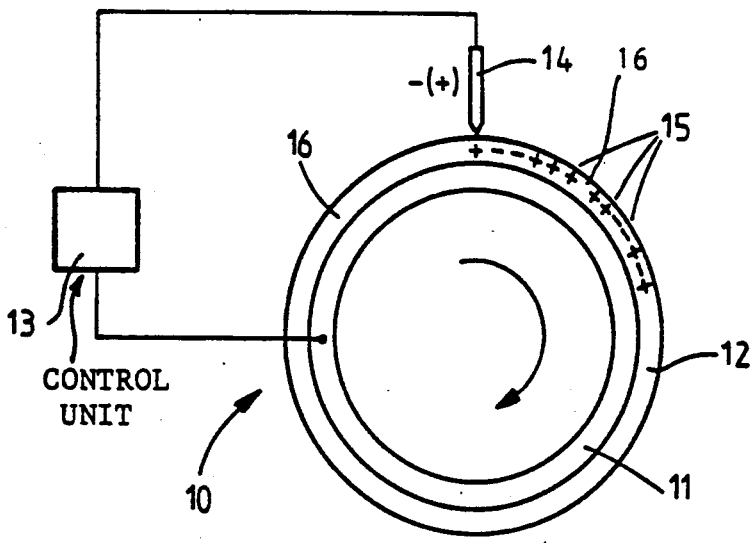
FIG. 1 is a highly schematic representation of a printing cylinder having an image applied thereto.

A cylindrical printing form cylinder 10, FIG. 1, is formed by a hollow cylindrical support structure 11, made of electrically conductive material.

In accordance with a feature of the invention, a layer 12 is applied to the support cylinder 11, the layer 12 having a surface of ferroelectric material. A printing head 14, controlled by a control unit 13 of well known construction, and connected to the electrically conductive cylinder 11, applies a charge and polarization and image 15 on the ferroelectric layer 12. The application of the charge and polarization image may use well known and conventional methods used to control a dielectric layer. The polarization and charge image will be the sum of the negative polarized raster or domain positions 15 on the ferroelectric material 12, the positively polarized domain positions, and the neutral domain positions. The charges applied to the surface are fixed and bound within the ferroelectric material 12 by orientation of the ferroelectric domains of the material upon polarization. They form a dual layer of charges and oppositely charged domains, which can be disturbed or erased by strong external fields or high temperatures.

Upon contact of the surface with electrically charged toner particles, the surface will not be neutralized, that is, the charge image will not dissappear and the charge will not dissipate or flow off. Polarization of the ferroelectric material remains until the charge image is changed under command of the control unit 13.

The neutral locations 16 remain free of ink toners; the positive points will attract negatively charged toner or ink particles and the negative points will attract positively charged ink particles or toner particles. The arrangement permits densely packed adjacent domains which may have the same or different polarity, or be neutral, which permits application of inks or toners of two different colors, by charging the ink or toner of one color positively and the ink or toner of another color negatively.

Figure 2:
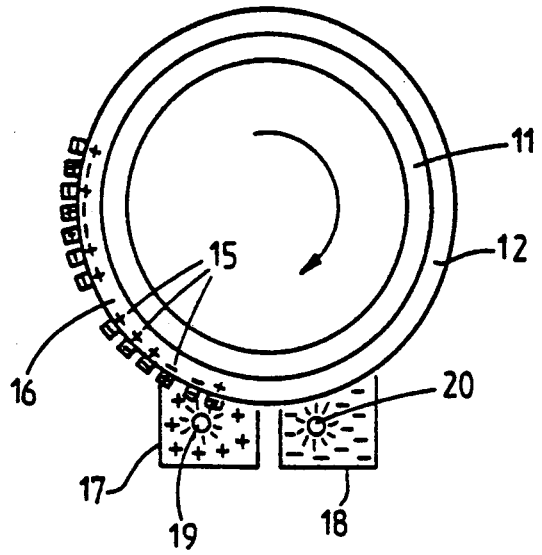
FIGS. 2 and 3 illustrate the printing cylinder of FIG. 1 in combination with subsequent steps in the printing method.

FIG. 2 illustrates application of ink to the cylinder of FIG. 1. Two toner containers 17 and 18 are provided, in which, for example, the container 17 retains positively charge yellow ink or toner particles. The second container 18 retains negatively charged red ink or toner particles. A charge unit CU applies the charge with the polarities as shown. When the cylinder 11 with the ferroelectric surface 12 thereon rotates past the toner containers 17, 18, brushes 19, 20 within the containers apply the respectively charged toner or ink particles against the ferroelectric surface 12. The ink particles will then adhere on the printing form 10 in accordance with the charge image 15 applied as explained in connection with FIG. 1.

Figure 3:
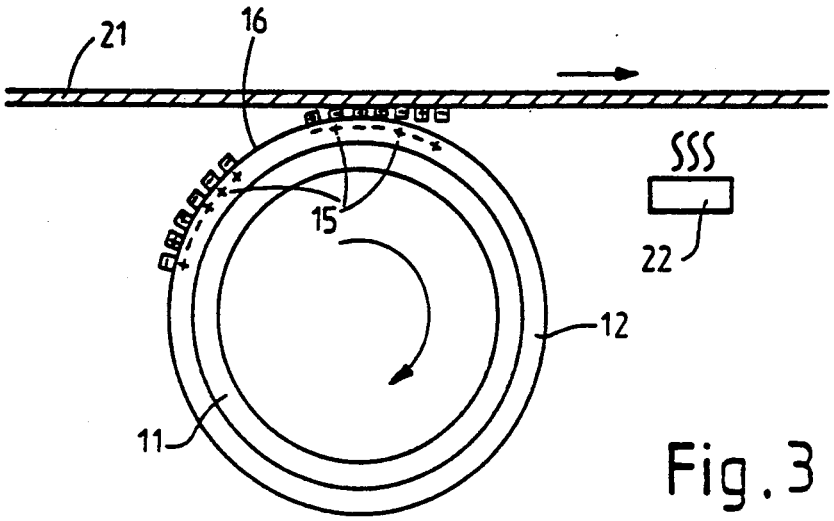

Upon passage of a web 21, FIG. 3, in contact with the cylinder 11, the ink or toner particles will be transferred to the substrate 21, to be set thereon by a heater 22.

By applying two differently colored and differently charged inks or toner particles, as explained in connection with FIG. 2, it is possible to obtain multi-color printing on the substrate 21 by a single pass over the cylinder 10, so that the number of passes through a printing station, for multi-color printing, can be reduced by two.

If only a single color ink is to be used, polarization of the ferroelectric surface can be carried out throughout with positive or negative polarity, that is, without the neutral positions or points 16. Different grey scales can then be generated either by differential field strengths, so that the quantity of ink or toner particles attracted is varied; or they can be generated by applying raster points of differential size, polarized to saturation.

The ink can be in form of a dry toner, or charged toner particles suspended within a carrier liquid.

Figure 4:
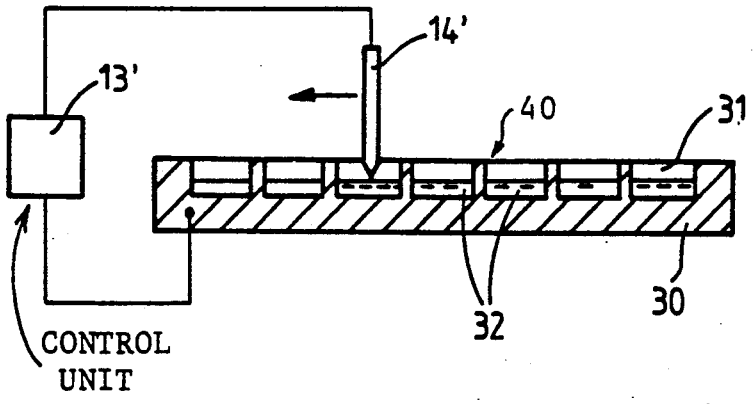
FIG. 4 is a highly schematic fragmentary cross-sectional view of a gravure cylinder in a processing step to apply thereto a printing image.
Figure 5:
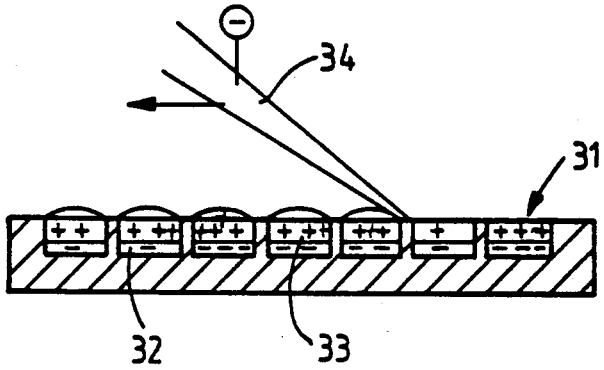
FIGS. 5 and 6 show the printing cylinder of FIG. 4 in subsequent steps of the process to obtain a printed image.
Figure 6:
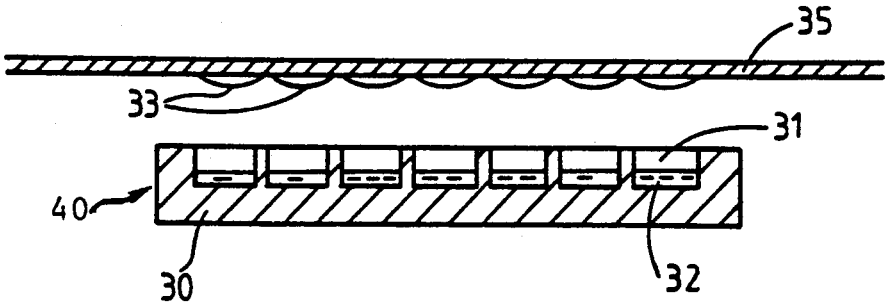

The present invention is applicable not only to planographic printing but also to different types of printing. FIGS. 4 to 6 illustrate an embodiment of the present invention in connection with a gravure printing plate.

A substrate 30 of the system 40 is formed at one of the surfaces with cells or receptor depressions 31, as well known. The substrate is made of a highly wear-resistant material, for example a strong metal or a ceramic. The cells 31 are of uniform size and are located in a matrix or raster formation on the surface of the substrate 30, as well known in gravure printing.

In accordance with a feature of the invention, the bottoms of the cells 31 include a ferroelectric layer 32. The ferroelectric layers are polarized by an electrode 14', coupled to control unit 13', in accordance with an image to be transferred, under control of the control unit 13', and similar to polarization of the layer or surface 12 as described in connection with FIGS. 1-3. After polarizing the layer 32, a toner 33, for example in liquid form, is applied to the cells 31 to fill the cells. The toner, upon filling of the cells, may extend slightly thereover, and in order to provide a smooth surface, excess liquid 33 is stripped off by a doctor blade 34. As schematically shown in FIG. 5, the toner particles have been pre-charged to receive a positive charge if the polarization of the ferroelectric surface 32 was negative, so that the toner will be electrostatically retained in the cells. The extent of polarization can be controlled from the control unit 13', so that the polarization is more or less negative. The doctor blade 34 is negatively charged, which, in dependence on the intensity of the polarity of the ferroelectric material 32, will draw out some of the toner 33 as the doctor blade runs or rides across the cells 31. Thus, the quantity of ink within the cells is controlled or a function of the extent of polarization applied by the electrode 14' under control of the control unit 13'. The cells 31 will retain that quantity of ink pigments which corresponds to the respective field strength of the associated ferroelectric material 32 within the respective cell. The remaining quantity of toner particles thus will correspond to the desired grey-value. As illustrated in FIG. 6, the thus properly quantified or dosed ink is transferred to the ink receiving substrate material 35 which is to be printed. After printing, the gravure element 30 can be refilled with polarized toner and passed beneath the doctor blade 34 (FIG. 5) and another printing substrate 35 can be printed.

The invention is applicable to various types of printing forms, but particularly to planographic printing and to gravure printing; for planographic printing, see FIGS. 1-3, the surface of the printing element, be it a cylinder or a flat plate, which will come in contact with the substrate to be printed is supplied with a ferroelectric layer 12. This printing form is then polarized, by the control unit 13 controlling the electrode 14 in a system which is well known and customary in electrostatic control of printing forms. The surface of the printing form is thus polarized in accordance with image information, in matrix or raster form; each image point or pixel will be more or less polarized in dependence on the associated grey-value of the respective pixel; or, if the ferroelectric layer is already subdivided into cells, see layer 33, FIGS. 4-6, the polarization can be directly carried out with respect to the particular cells. The thus generated charge and polarization pattern, representing the image to be printed as controlled by the control unit 13, 13', then is brought into contact with an arrangement to apply ink, for example the brushes 19, 20 (FIG. 2) which apply a charged dry toner or a toner in suspension against the polarized surface 12, which will accept, in point-by-point pattern, more or less ink on the specific local point areas. Upon contact of the surface, which has thus been inked, with a printing substrate and, if desired, a counter electrode, ink is transferred to the printing substrate. Rather than using a dry toner, a liquid toner in which the toner particles or ink is suspended in the carrier liquid can be used.

The printing form in accordance with the present invention can also be used in a different manner, namely by applying the toner, in accordance with the image to be printed, on the printing form and then securing or fixing it thereon by application of heat, pressure, or chemical adhering reactions. The toner will then be fixed or attached to the printing form. The toner will, on the printing form, provide a hydrophobic region, in accordance with the image to be printed, which, however, will be oleophilic, that is, accepting fatty inks. Those regions of the printing form which are free from toner are hydrophilic, that is, water-accepting. Use of the method in accordance with the present invention in this way has an advantage with respect to known printing forms, in that the fixed ink regions can be regenerated without additional control thereof by the electrode 14, 14' under control of the control unit 13, 13'. Long or extensive printing runs may cause the fixed toner to flake or peel off the printing form; under such conditions, the hydrophobic and hence oleophilic regions must be regenerated. Printing forms with dielectric layers require re-programming by the control unit 13, 13' and the electrode 14, 14'; the printing form, however, with the ferroelectric layer has the advantage that it is only necessary to re-apply toner, and renewed refreshing of the previously commanded image information, that is, regeneration of the polarized regions is not necessary.

The printing forms may be used in printing machines, as well as other multiplication apparatus, such as copiers and the like.

Various changes and modifications may be made and any features described herein may be used with any of the others, within the scope of the inventive concept.

We claim:

1. A method of printing comprising providing a printing form support (11, 30) having thereon a particle transferring ferroelectric layer (12, 32);

selectively polarizing said ferroelectric layer (12, 32), point-by-point, in accordance with an image to be reproduced, in a selected direction of polarization to generate polarized domains of selected directions of polarization on said ferroelectric layer;

selectively electrically charging toner or ink particles with a polarity opposite the polarity of polarization of the respective points of the ferroelectric layer (12, 32); and applying said charged toner or ink particles on said point-by-point polarized ferroelectric layer (12, 32) by attraction of the respective reversely charged toner or ink elements on selectively oppositely polarized domains of the ferroelectric layer.

2. The method of claim 1, wherein said toner or ink particles or elements have the capability of transfer to a printing substrate (21, 35).

3. The method of claim 1, wherein said toner or ink particles or elements have the capability of selective acceptance or rejection of printing ink and printing damping fluid on the surface of said toner or ink particles or elements.

4. A printing system comprising the combination of a printing form (10, 40) for reproducing an image with toner or ink elements for selectively toning or inking said printing form, said system comprising an ink transferring layer (12, 32) on the printing form;

means (11, 30) for supporting said ink transferring layer (12, 32) on the printing form, wherein said ink transferring layer (12, 32) of the printing form in a ferroelectric material layer;

means (13, 14) for selectively polarizing said ferroelectric material layer in accordance with said image to be reproduced to have polarized domains; and charging means (CU) for selectively electrically charging said toner or ink elements, so that said ferroelectric layer will selectively attract charged toner or ink elements which are charge oppositely with respect to the polarization of the polarized domains, electrode means (14, 14') positioned in electric field transfer relation with respect to said ferroelectric layer (12);

control means (13, 13') controlling the electrode means (14, 14') for applying an electric field to said ferroelectric layer (12); and wherein said control means (13, 13') controls the electrode means (14, 14') to polarize the ferroelectric layer (12), selectively in either positive polarity, negative polarity, or to leave selected areas of said ferroelectric layer (12) unpolarized.

5. The printing system of claim 4, wherein said supporting means comprises a carrier structure (11, 30);

and wherein said ink transferring layer (12) comprises a surface coating on the carrier structure.

6. The system of claim 4, wherein (FIGS. 1-3) said support means for the ink transferring layer comprises an essentially smooth surface coated by said ferroelectric layer (12).

7. The system of claim 4, wherein said toner or ink elements comprise hydrophobic material to form hydrophobic regions where said charged elements are applied on said ferroelectric layer (12, 32).

8. The printing system of claim 4, wherein (FIGS. 4–6) said means for supporting the ink transferring layer (32) comprises a substrate (30) formed with gravure cells (31);

and wherein said ferroelectric layer (12) is located on the bottom of the gravure cells.

9. The system of claim 8, further including a control unit (13') and an electrode (14'), the electrode being positioned in electrical field-transferring relation with respect to the ferroelectric layer (32)in the gravure cells (31), and said control unit controlling said electrode for polarization of selectively different levels of intensity and in predetermined directions of polarity.

10. A printing system comprising the combination of a printing form (10, 40) for reproducing an image with toner or ink elements for selectively toning or inking said printing form, said system comprising an ink transferring layer (12, 32) on the printing form;

means (11, 30) for supporting said ink transferring layer (12, 32) on the printing form, wherein said ink transferring layer (12, 32) of the printing form is a ferroelectric material layer;

means (13, 14) for selectively polarizing said ferroelectric material layer in accordance with said image to be reproduced to have polarized domains; and charging means (CU) for selectively electrically charging said toner or ink elements, so that said ferroelectric layer will selectively attract charged toner or ink elements which are charged oppositely with respect to the polarization of the polarized domains, a control unit (13) and an electrode (14), the electrode being positioned in electrical field-transferring relation with respect to the ferroelectric layer (12, 32) on said printing form (10, 40).

said control unit controlling said electrode for polarization of first selected regions beneath said electrode in one direction of polarization and for polarization of second selected regions beneath said electrode in an opposite direction of polarization;

and wherein said charging means (CU) for said toner or ink elements apply a charge to a portion of toner or ink elements in the first direction of charge polarization and to another portion of said toner or ink elements to an opposite direction of charge polarization, whereby, upon application of said toner or ink elements to said selectively oppositely polarized domains of said regions opposite charges on the toner or ink elements and said surface regions will attract the respective reversely charged toner or ink elements.

11. The printing system of claim 10, wherein said supporting means comprises a carrier structure (11, 30);

and wherein said ink transferring layer (12) comprises a surface coating on the carrier structure.

12. The system of claim 10, wherein (FIGS. 1–3) said support means for the ink transferring layer comprises an essentially smooth surface coated by said ferroelectric layer (12).

13. The system of claim 10, wherein said charge unit (CU) controls said electrode to leave portions of said ferroelectric layer (12, 13) unpolarized and uncharged.

14. The system of claim 10, wherein said control unit (13) controls the electrode to, selectively, polarize the respective regions beneath the electrode with different levels of intensity whereby, upon application of said charged toner or ink elements, selectively different attractive forces between said elements and said regions will result.

15. The printing system of claim 10, wherein (FIGS. 4–6) said means for supporting the ink transferring layer (32) comprises a substrate (30) formed with gravure cells (31);

and wherein said ferroelectric layer (12) is located on the bottom of the gravure cells.

16. These system of claim 15, wherein the electrode is positioned in electrical field-transferring relation with respect to the ferroelectric layer (32) in the gravure cells (31), and said control means controls said electrode for polarization of selectively different levels of intensity and in predetermined directions of polarity.

* * * * *